US007467605B2

(12) United States Patent
Szalony et al.

(10) Patent No.: US 7,467,605 B2
(45) Date of Patent: Dec. 23, 2008

(54) THERMAL ENERGY RECOVERY AND MANAGEMENT SYSTEM

(75) Inventors: Norman Szalony, Brighton, MI (US); Stephen Think Hung, Grosse Pointe Park, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 293 days.

(21) Appl. No.: 11/441,979

(22) Filed: May 26, 2006

(65) Prior Publication Data

US 2007/0272174 A1 Nov. 29, 2007

(51) Int. Cl.
*F01P 7/02* (2006.01)
*B60H 1/03* (2006.01)
*F02N 17/02* (2006.01)
*F02N 17/06* (2006.01)

(52) U.S. Cl. ..... 123/41.04; 123/142.5 R

(58) Field of Classification Search ..... 123/41.14, 123/142.5 R; 237/12.3 R, 12.3 A, 12.3 B
See application file for complete search history.

(56) References Cited

U.S. PATENT DOCUMENTS 2,285,720 A * 6/1942 Joy ..... 184/104.2
5,611,392 A 3/1997 Malecek et al.
6,138,649 A * 10/2000 Khair et al. ..... 123/568.12
6,327,149 B1 12/2001 Goenka
6,374,780 B1 4/2002 Rutyna et al.
6,470,682 B2 * 10/2002 Gray, Jr. ..... 60/605.2
6,520,136 B2 * 2/2003 Ito et al. ..... 123/142.5 R
6,571,752 B1 6/2003 Suzuki
6,629,512 B2 10/2003 Iwatani et al.
6,647,961 B2 11/2003 Suzuki et al.
6,668,764 B1 12/2003 Henderson et al.
6,668,766 B1 12/2003 Liederman et al.
6,681,725 B2 1/2004 Kobayashi et al.
6,758,172 B2 7/2004 Morgan et al.
6,769,623 B2 8/2004 Ban et al.
6,772,715 B2 * 8/2004 Pfeffinger et al. ..... 123/41.31
6,802,283 B2 10/2004 Liederman et al.
6,830,527 B2 * 12/2004 Wakayama ..... 475/161
6,868,809 B1 3/2005 Robb
6,895,904 B2 5/2005 Kobayashi et al.
6,915,763 B2 7/2005 Arisawa et al.
7,032,885 B2 4/2006 Rauch et al.
7,140,330 B2 * 11/2006 Rogers et al. ..... 123/41.14
7,146,800 B2 * 12/2006 Toshioka et al. ..... 60/285
2002/0195068 A1 12/2002 Ichinose et al.
2004/0200443 A1 10/2004 Iinuma et al.
2005/0022769 A1 2/2005 Kuze et al.
2005/0229873 A1 * 10/2005 Willers ..... 123/41.14

OTHER PUBLICATIONS

Yasuhiro Kuze et al, Development of New General Hybrid System (THS II)—Development of Toyota Coolant Heat Storage System, SAE Technical Paper Series 2004-01-0643, Mar. 8-11, 2004, 10 pages.
Ngy-Srun Ap et al, Innovative Engine Cooling System Comparison, SAE Technical Paper Series 2005-01-1378, 12 pages.

* cited by examiner

*Primary Examiner*—Stephen K Cronin
*Assistant Examiner*—Sizo B Vilakazi
(74) *Attorney, Agent, or Firm*—Fraser Clemens Martin & Miller LLC; J. Douglas Miller

(57) ABSTRACT

A thermal energy recovery and management system for an internal combustion engine for balancing the heat energy between a primary reservoir and the engine to maximize an operating efficiency of the engine and associated engine components. The primary reservoir storing or releasing heat energy produced by the engine to achieve a balance of energy between the engine and associated components.

10 Claims, 11 Drawing Sheets

THERMAL ENERGY RECOVERY AND MANAGEMENT SYSTEM

FIELD OF THE INVENTION

The present invention relates to a thermal energy recovery and management system and more particularly to an energy recovery system capable of transferring heat energy to and from various components of an internal combustion engine for powering a vehicle to effect improved emission control, fuel efficiency, and engine durability.

BACKGROUND OF THE INVENTION

It is known that stored thermal energy may be employed to reduce exhaust emission pollutants from an internal combustion engine by facilitating engine warm-up. Stored thermal energy may also be provided to the engine to minimize engine warm-up time and reduce cold start engine-wear, thereby increasing engine durability. Further, the more rapidly the engine is heated, the quicker the engine will operate at increased efficiencies to improve fuel consumption characteristics.

The broad concept of the utilization of thermal energy storage systems for internal combustion engines employing a thermal energy storage device capable of efficiently supplying thermal energy from the thermal energy storage device to an internal combustion engine is disclosed in a paper entitled Development of New Generation Hybrid System identified as SAE Technical Paper Series 2004-02-0643, hereby incorporated herein by reference in its entirety.

Automotive vehicle emissions, fuel economy, and power train durability are heavily influenced by warming conditions during engine start-up. To enhance engine warming conditions, thermal energy storage devices have been developed to store a gas or liquid medium at high normal operating temperatures. Many of such systems employ a phase change material (PCM) that has been exposed to a solid-liquid or liquid-gas phase change heat of fusion to optimize the latent heat energy storage thermal capacity of the associated working medium. The phase change materials currently used are typically corrosive and when used with working medium result in significant additional vehicle cost and space requirements.

It is therefore considered desirable to produce a thermal energy recovery and management system for an internal combustion engine which stores a heated working medium in a insulated bottle which is released into the internal combustion engine operating system to minimize emissions in an exhaust gas from unburned hydrocarbons, maximize fuel efficiency, and minimize engine wear, especially during cold start conditions.

SUMMARY OF THE INVENTION

Harmonious with the present invention, a thermal energy recovery and management system for an internal combustion engine which stores a heated working medium in a insulated bottle which is released into the internal combustion engine operating system to minimize emissions in an exhaust gas from unburned hydrocarbons, maximize fuel efficiency, and minimize engine wear, especially during cold start conditions has surprisingly been discovered.

In one embodiment thermal energy recovery and management system comprises an engine; a primary reservoir for storing thermal energy; a first fluid circuit providing fluid communication between the primary reservoir and the engine; an electric control unit for selectively monitoring the communication in the fluid circuit between the primary reservoir and the engine to maintain a balance of thermal energy in the primary reservoir and the engine; and a means for providing a motive force for causing a thermal energy conveying fluid to flow between the primary reservoir and the engine.

In another embodiment, a thermal energy recovery and management system comprises an engine; a primary reservoir for storing thermal energy; at least one sub-reservoir in thermal energy exchange relationship with the primary reservoir and in energy conveying fluid communication with at least one of the engine, a transmission, and an exhaust gas recirculator; a first fluid circuit providing communication between the primary reservoir and the engine; a second fluid circuit providing communication between the at least one sub-reservoir and at least one of the engine, a transmission, and an exhaust gas recirculator; an electric control unit for selectively monitoring the communication in the first fluid circuit between the primary reservoir and the engine, and in the second fluid circuit between the at least one sub-reservoir and at least one of the engine, the transmission, and the exhaust gas recirculator to maintain a balance of thermal energy in the reservoirs, the internal combustion engine, and at least one of the engine, the transmission, and the exhaust gas recirculator; a means for providing a motive force for causing a thermal energy conveying fluid to flow between the primary reservoir and the engine; and a means for providing a motive force for causing a thermal energy conveying fluid to flow between the at least one sub-reservoir and at least one of the engine, the transmission, and the exhaust gas recirculator.

In another embodiment, a thermal energy recovery and management system including at least an engine, an exhaust gas recirculation, and a transmission wherein the system comprises a primary reservoir for storing thermal energy; a first sub-reservoir in thermal energy exchange relationship with the primary reservoir and in energy conveying fluid communication with the engine; a second sub-reservoir in thermal energy exchange relationship with the primary reservoir and in energy conveying fluid communication with the transmission; a third sub-reservoir in thermal energy exchange relationship with the primary reservoir and in energy conveying fluid communication with the exhaust gas recirculator; a first fluid circuit providing communication between the primary reservoir and at least one of a radiator and a heater core; a second fluid circuit providing communication between the first sub-reservoir and the engine; a third fluid circuit providing communication between the second sub-reservoir and the transmission; a fourth fluid circuit providing communication between the third sub-reservoir and the exhaust gas recirculator; an electric control unit for selectively monitoring the communication in the first fluid circuit between the primary reservoir and at least one of the radiator and the heater core, in the second fluid circuit between the first sub-reservoir and the engine, in the third fluid circuit between the second sub-reservoir and the transmission, and in the fourth fluid circuit between the third sub-reservoir and the exhaust gas recirculator to maintain a balance of thermal energy in the reservoirs, the engine, transmission, and the exhaust gas recirculator; a means for providing a motive force for causing a thermal energy conveying fluid to flow between the primary reservoir and at least one of the radiator and the heater core; a means for providing a motive force for causing a thermal energy conveying fluid to flow between the first sub-reservoir and the engine; a means for providing a motive force for causing a thermal energy conveying fluid to flow between the second sub-reservoir and the transmission; and a means for providing a motive force for causing a thermal energy conveying fluid to flow between the third sub-reservoir and the exhaust gas recirculator.

The aforesaid system utilizes a thermal energy storage reservoir of sufficient capacity that when the engine is in a steady state operating mode, the reservoir functions as an inherent energy balance device to release or store thermal energy to either heat or cool one or more of the engine cooling radiator, engine oil, transmission oil, and exhaust gas recirculator to operate the systems as close as possible to an optimal temperature range.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
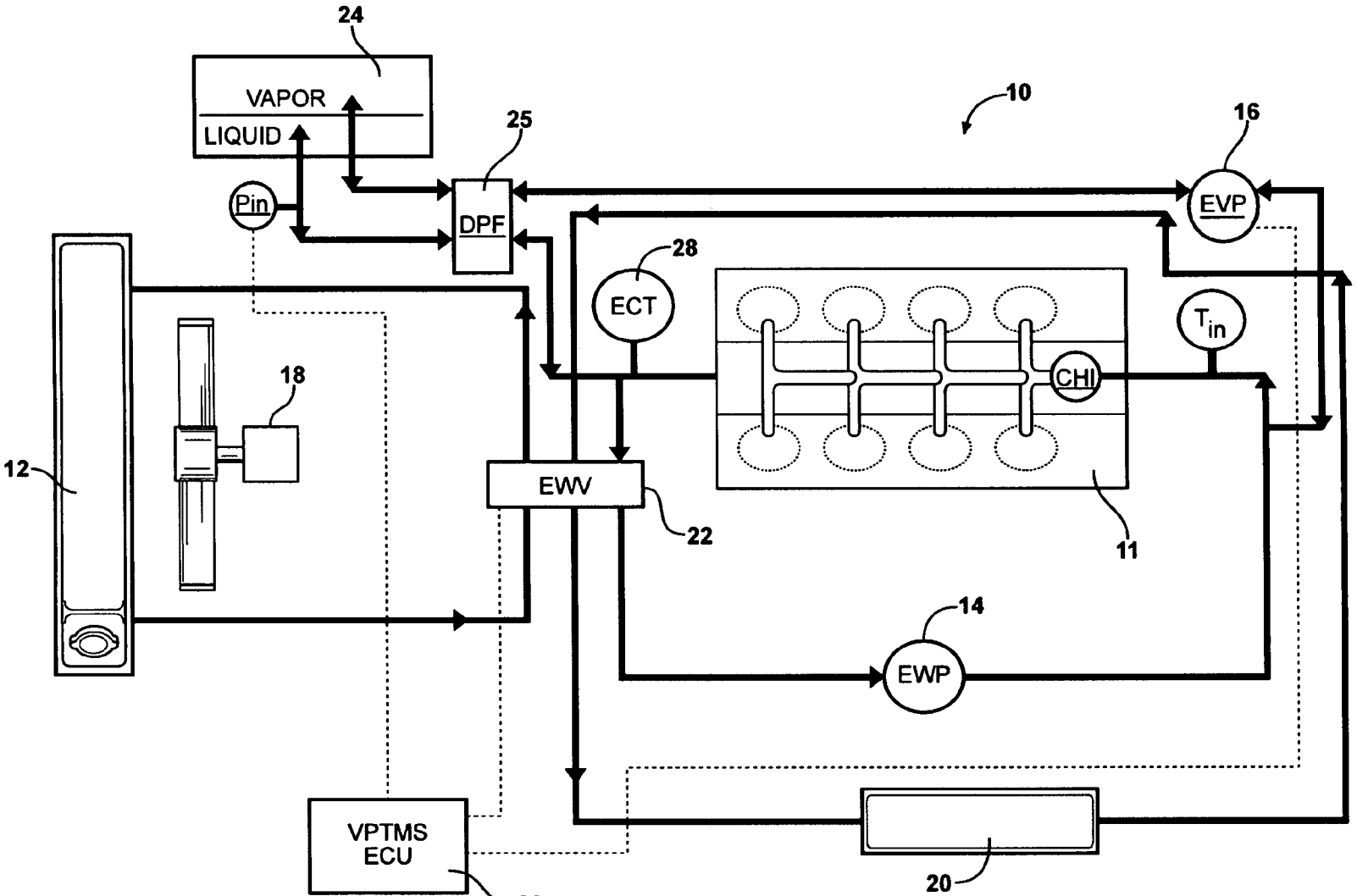
FIG. 1 is a schematic illustration of a thermal energy storage and management system for an internal combustion engine according to an embodiment of the invention, wherein the system is in an exemplary system operations mode.

FIG. 1 shows a thermal energy recovery and management system 10 according to an embodiment of the invention. The system 10 includes an internal combustion engine 11, which is provided with a heating and cooling system. The heating and cooling system includes a cooling radiator 12, an electric water pump 14, an electric vapor pump 16, an electric fan 18, a heater core 20, a three position electric solenoid actuated valve 22, a thermal energy storage reservoir 24, a differential pressure valve 25 and an electric control unit 26. Although specific elements such as electric water pump, electric vapor pump, electric fan, and electric solenoid actuated valve are described herein, for example, it is understood that equivalent structures can be used such as valves actuated in other manners, for example. A temperature sensor 28 is disposed subsequent an exit of the engine 11 and is suitably coupled, typically electrically, with the electric control unit 26.

Fluid communication is established between the engine 11, the radiator 12, and the heater core 20, via the three position electric solenoid actuated valve 22. The three position electric solenoid actuated valve 22 can permit or militate against the flow of fluid between each of the engine 11, the radiator 12, and the heater core 20 universally, wherein flow is permitted or militated against between all of the engine 11, the radiator 12, and the heater core 20. As used hereinafter, the term fluid can refer to liquid, vapor, steam, gas, or any combination thereof. The three position electric solenoid valve 22 can also selectively permit or militate against the flow of fluid between the engine 11, the radiator 12, and the heater core 20 separately.

Fluid communication is established between the engine 11 and the thermal energy storage reservoir 24 via the differential pressure valve 25. It will be appreciated that the various components of the system are coupled together, as illustrated, by appropriate fluid conveying conduits such as tubing and piping, for example.

The thermal energy storage reservoir 24 may be of a number of different types. The thermal energy storage reservoir 24 is capable of receiving a fluid used to convey thermal energy developed during the normal operation of the engine 11. Optionally, the thermal energy storage reservoir 24 may be a type wherein the phase of the fluid is changed such as from a liquid state to a gaseous state, for example. One example is a jar or bottle having a vacuum between an inner and outer wall, and sited to contain engine radiator coolant fluid as a primary thermal energy transfer medium. As will be explained in more detail hereinafter, the reservoir 24 can also enclose one or more sub-system reservoirs, in the range of from one to two liter capacity, to contain engine oil, transmission oil, and exhaust gas recirculator coolants. Favorable results have been realized when the thermal energy storage reservoir 24 is formed of an inner vessel and an outer housing separated by a vacuum which has been found to maintain thermal energy for a period up to seventy-two hours and having a volume of between 8 and 10 liters, for example.

During an exemplary system operations mode as illustrated in FIG. 1, the three position electric solenoid operated valve 22 and the differential pressure valve 25 are actuated by appropriate electrical signals from the electric control unit 26 based on a temperature reading supplied to the control unit 26 from the temperature sensor 28. The motive forces produced by the electric water pump 14 and the electric vapor pump 16 selectively cause the fluid to be conveyed through the passageways to transfer thermal energy through the engine 11, the radiator 12, the heater core 20, and the thermal energy storage reservoir 24 based on appropriate electrical signals from the control unit 26. Specifically, the electric water pump 14 causes the fluid in a liquid state to flow through the three position electric solenoid operated valve 22 to the engine 11, the radiator 12, and the heater core 20. The electric water pump 14 can also cause the fluid in liquid state to flow through the differential pressure valve 25 to the thermal energy storage reservoir 24. The electric vapor pump 16 causes the fluid in a vapor or gaseous state to travel from the thermal energy storage reservoir 24 through the differential pressure valve 25 to the engine 11. The electric vapor pump 16 can also cause the fluid in vapor or gaseous state to flow through the three position electric solenoid operated valve 22 where it can be subsequently diverted to the engine 11 or the heater core 20 and then back to the thermal energy storage reservoir 24 by an appropriate signal from the electric control unit 26.

The thermal energy of the system may be controlled by the three position electric solenoid operated valve 22 and the differential pressure valve 25 which control the rate of flow of fluid therethrough and hence through the heat exchange elements of the radiator 12, the heater core 20, and the thermal energy storage reservoir 24. Specifically, the three position electric solenoid operated valve 22 permits or militates against the flow of fluid to the engine 11, the radiator 12, and the heater core 20 based on an appropriate signal from the control unit 26. The differential pressure valve 25 permits or militates against the flow of fluid to and from the thermal energy storage reservoir 24.

The thermal energy storage reservoir 24 is utilized to store thermal energy from the engine 11 as the fluid is forced to flow through the system by the motive force produced by the electric water pump 14 and the electric vapor pump 16. The thermal energy storage reservoir 24 acts as an inherent thermal energy balance device, to either add heat energy to or remove heat energy from the thermal energy storage and management system. It will be understood that the thermal energy storage reservoir 24 is effective to efficiently retain heat energy and allow the energy transfer fluid retained therein to absorb heat energy from or release heat energy to the engine 11, the radiator 12, or the heater core 20. Due to the insulating properties of the thermal energy storage reservoir 24, the thermal energy transfer fluid flowing therethrough minimizes energy loss so that when the system 10 is shut down, the thermal energy transfer fluid within the thermal energy storage reservoir 24 will maintain the thermal energy for subsequent use. If the phase changing function is utilized by the thermal energy storage reservoir 24, fluid that enters in a liquid state can be heated and changed into a vapor or gaseous state. Energy needed to implement the phase change can be supplied by any traditional means such as a battery powered thermal electrical device, for example.

The advantages achieved by the illustrated and described thermal energy and management system 10 includes start-up efficiencies of the associated engine. Immediately upon start-up, the system 10 utilizes the stored thermal energy to heat components of the engine. Therefore, the wear on the engine during start-up is substantially reduced, resulting in increased engine durability. If desired, the passenger cabin can also be supplied with heat immediately upon start-up. Fuel efficiency is maximized and exhaust gas pollutants are minimized due to the engine more rapidly reaching a maximum operating temperature. Suitable signals from the electrical control unit 26 will effectively controls the flow of heat energy to or from the thermal energy storage reservoir 24.

Figure 2:
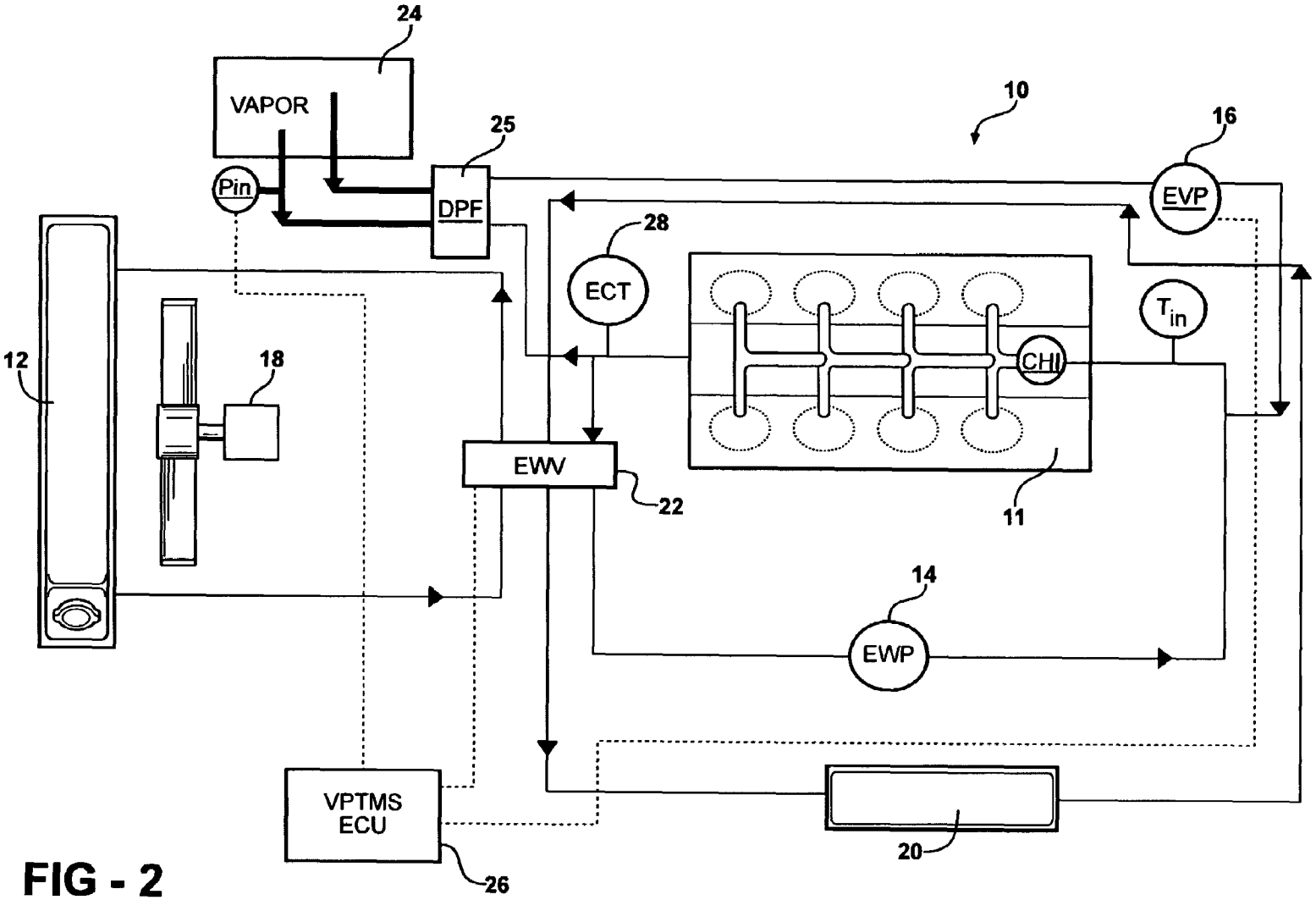
FIG. 2 is a schematic illustration of the thermal energy storage and management system in a cold soak operations mode.

FIG. 2 illustrates the thermal energy storage and management system 10 for the engine 11 shown in FIG. 1 with the system in a cold soak operating mode. In this operating mode, the engine 11 is off and the electric water pump 14 and the electric vapor pump 16 are not operating. The differential pressure valve 25 and the three position electric solenoid actuated valve 22 are in closed positions to militate against the passage of fluid therethrough. Accordingly, fluid is retained in the engine 11, the radiator 12, the heater core 20, and thermal energy storage reservoir 24. The cold soak operating mode is utilized to store thermal energy in the thermal energy storage reservoir 24.

Figure 3:
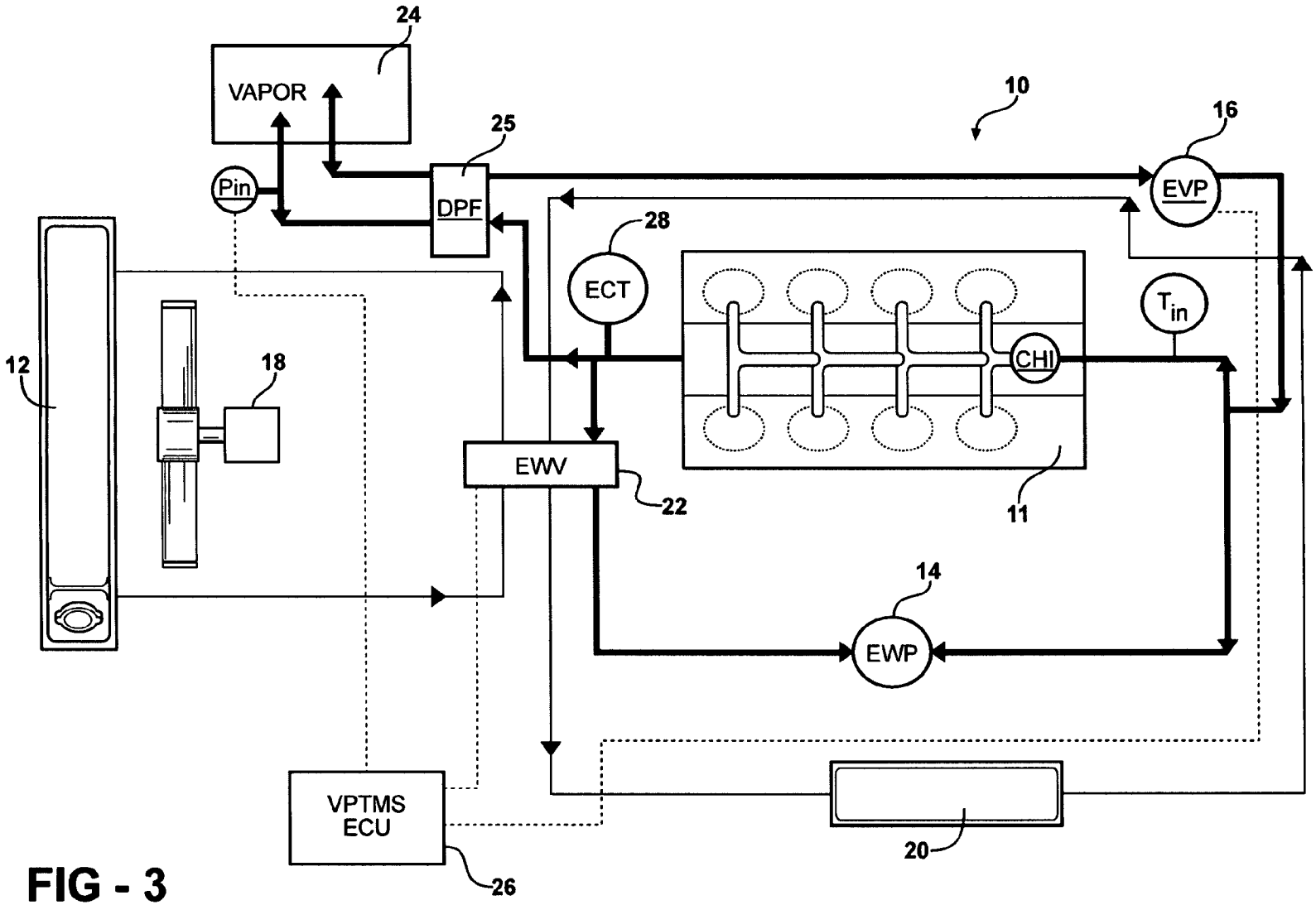
FIG. 3 is a schematic illustration of the thermal energy storage and management system when the system is in a pre-heat operating mode.

FIG. 3 illustrates the thermal energy storage and management system 10 for the internal combustion engine 11 shown in FIG. 1 with the system in a pre-heat operating mode. In the pre-heat operating mode, the engine 11 can be on or off and the electric water pump 14 is not operating. The differential pressure valve 25 is in an open position to allow fluid to travel therethrough. The three position electric solenoid actuated valve 22 is in universally closed position to militate against the flow of fluid therethrough. Heated fluid is pumped from the thermal energy storage reservoir 24 by the electric vapor pump 16 through the differential pressure valve 25. The heated fluid flows through and transfers thermal energy to the engine 11 and thereafter flows back through the differential pressure valve 25 and to the thermal energy storage reservoir 24 where it can be reheated by stored thermal energy and redistributed to the engine 11 facilitated by an appropriate signal from the electric control unit 26. The pre-heat operating mode is utilized to transfer stored thermal energy from fluid located in the thermal energy storage reservoir 24 to the engine 11.

Figure 4:
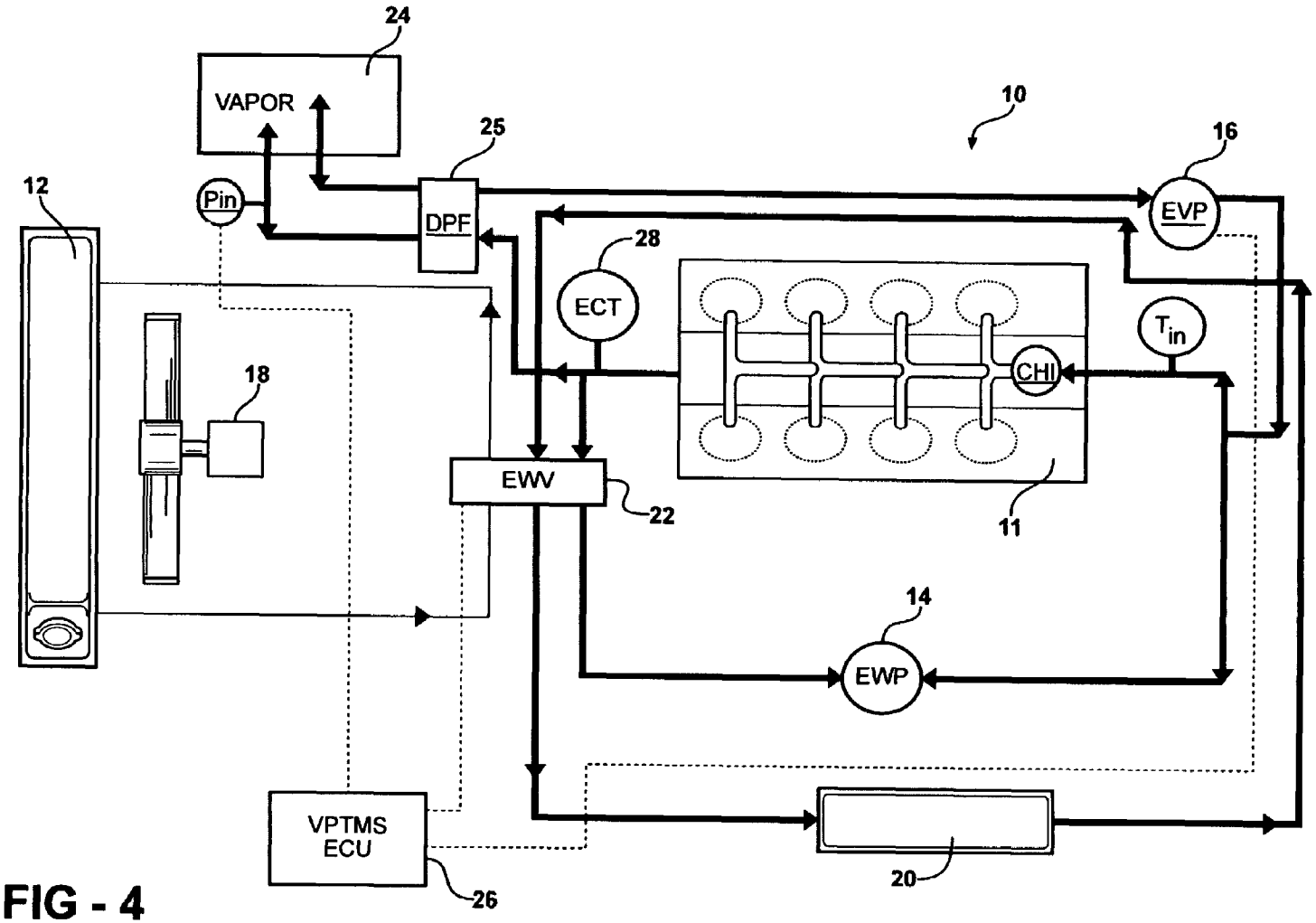
FIG. 4 is a schematic illustration of the thermal energy storage and management system in another pre-heat operating mode.

FIG. 4 illustrates the thermal energy storage and management system 10 for the internal combustion engine 11 shown in FIG. 1 in accordance with the system 10 in another pre-heat operating mode. In this pre-heat operating mode, the engine 11 can be on or off and the electric water pump 14 is not operating. The differential pressure valve 25 is in an open position to allow fluid to travel therethrough. The three position electric solenoid actuated valve 22 is open to permit the flow of fluid from the engine 11 to the heater core 20, but closed to militate against the flow of fluid to or from the radiator 12. Heated fluid is pumped from the thermal energy storage reservoir 24 through the differential pressure valve 25 by the electric vapor pump 16. The heated fluid flows through and transfers thermal energy to the engine 11. Thereafter, the fluid flows through the differential pressure valve 25 back to the thermal energy storage reservoir 24 where it can be reheated by stored thermal energy and redistributed as actuated by an appropriate electrical signal from the control unit 26. Alternately, the fluid can flow through the three position electric solenoid actuated valve 22 to the heater core 20 to transfer thermal energy to the heater core 20. The fluid can then recirculate through the three position electric solenoid actuated valve 22 and back to the heater core 20 facilitated by an appropriate signal from the control unit 26. This alternate pre-heat operating mode is utilized to transfer stored thermal energy from fluid located in the thermal energy storage reservoir 24 to the engine 11 and to the heater core 20.

Figure 5:
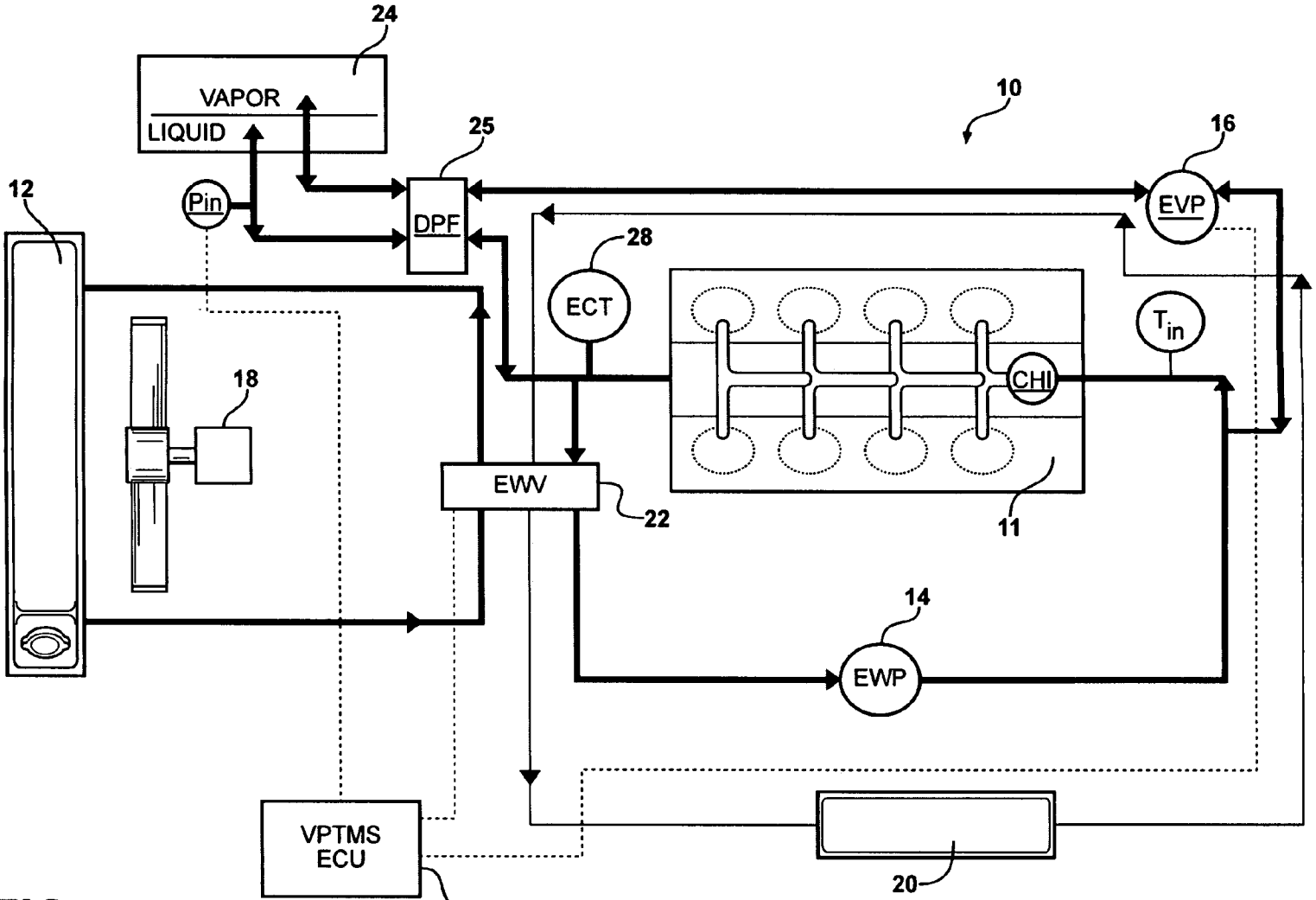
FIG. 5 is a schematic illustration of the thermal energy storage and management system when the system is in an optimal engine cooling and performance operating mode.

FIG. 5 illustrates the thermal energy storage and management system 10 for the internal combustion engine 11 shown in FIG. 1 with the system 10 in an engine cooling and performance operating mode. In the engine cooling and performance mode, the engine 11 is on and the electric vapor pump 16 is not operating. The differential pressure valve 25 is closed to militate against the flow of fluid therethrough. The three position electric solenoid actuated valve 22 is open to permit the flow of fluid between the engine 11 and the radiator 12, but closed to militate against the flow of fluid to and from the heater core 20. The electric fan 18 is operating to assist in transfer of thermal energy from fluid in the radiator 12. The fluid is then pumped by the electric water pump 20 through the three position electric solenoid actuated valve 22 to the engine 11. Thereafter, the fluid can be recirculated by the electric water pump 14 back to the radiator 12 and back to the engine 11 facilitated by an appropriate signal from the control unit 26. The engine cooling and performance operating mode is utilized to transfer thermal energy from fluid located in the radiator 12 and transfer thermal energy from the engine 11 to the fluid.

Figure 6:
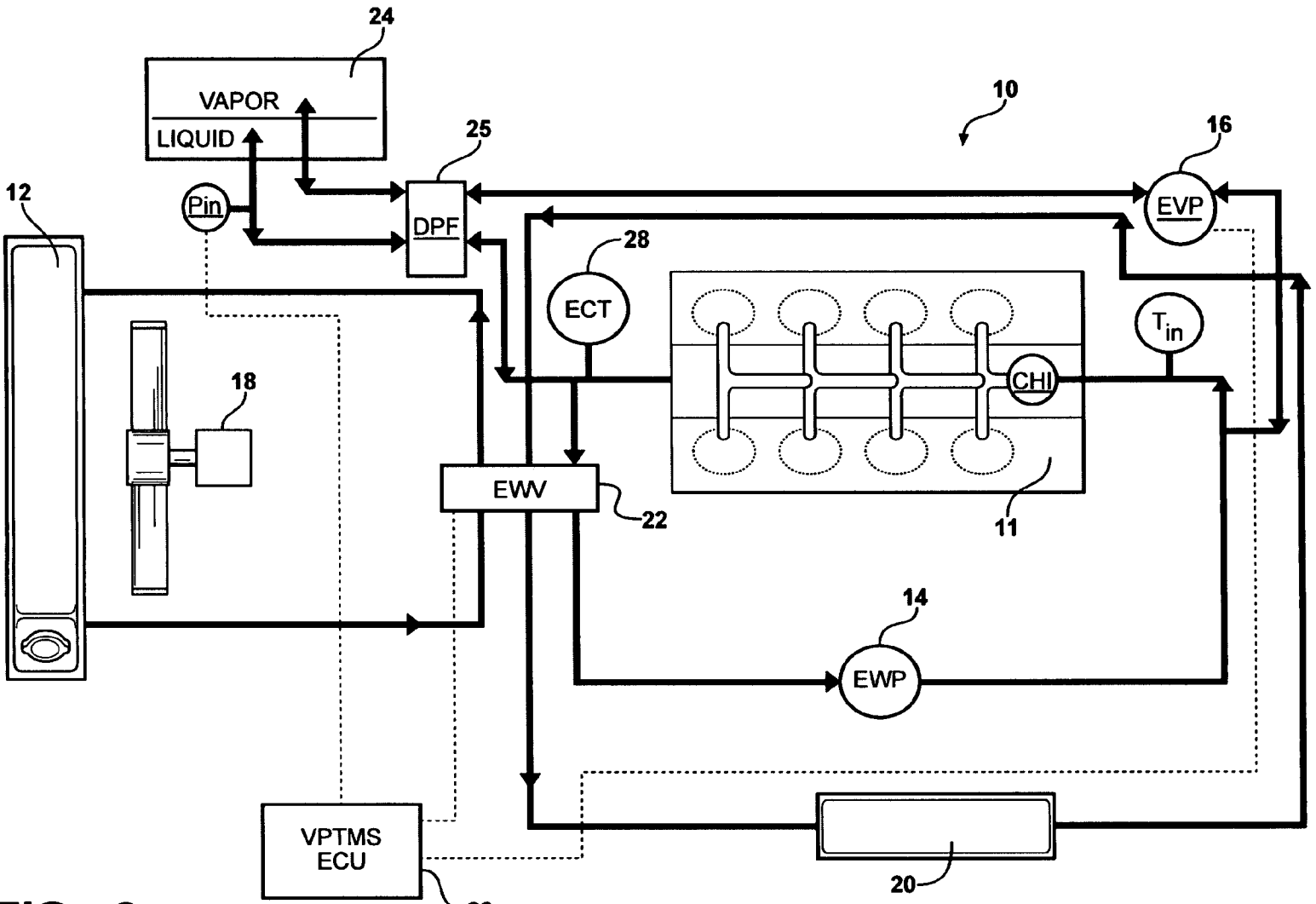
FIG. 6 is a schematic illustration of the thermal energy storage and management system when the system is in a normal full operating mode.

FIG. 6 illustrates the thermal energy storage and management system 10 for the internal combustion engine 11 shown in FIG. 1 with the system 10 in a normal full operating mode. In the normal full operating mode, the engine 11 is on and the electric vapor pump 16 is not operating. The differential pressure valve 25 is closed to militate against the flow of fluid therethrough. The three position electric solenoid actuated valve 22 is universally open to permit the flow of fluid between the engine 11, the radiator 12, and the heater core 20. The electric fan 18 is operating to facilitate transfer of thermal energy from fluid in the radiator 12. Thermal energy is also transferred from fluid in the heater core 20. The fluid is pumped by the electric water pump 14 from the radiator 12 or the heater core 20 through the three position electric solenoid actuated valve 22 to the engine 11 facilitated by an appropriate signal from the control unit 26. Thereafter, the fluid can be recirculated by the electric water pump 14 back to the radiator 12 or the heater core 20 and then back to the engine 11 facilitated by an appropriate signal from the control unit 26. The normal full operating mode is utilized to transfer thermal energy from fluid located in the radiator 12 or the heater core 20 as needed and transfer thermal energy from the engine 11 to the fluid.

Figure 7:
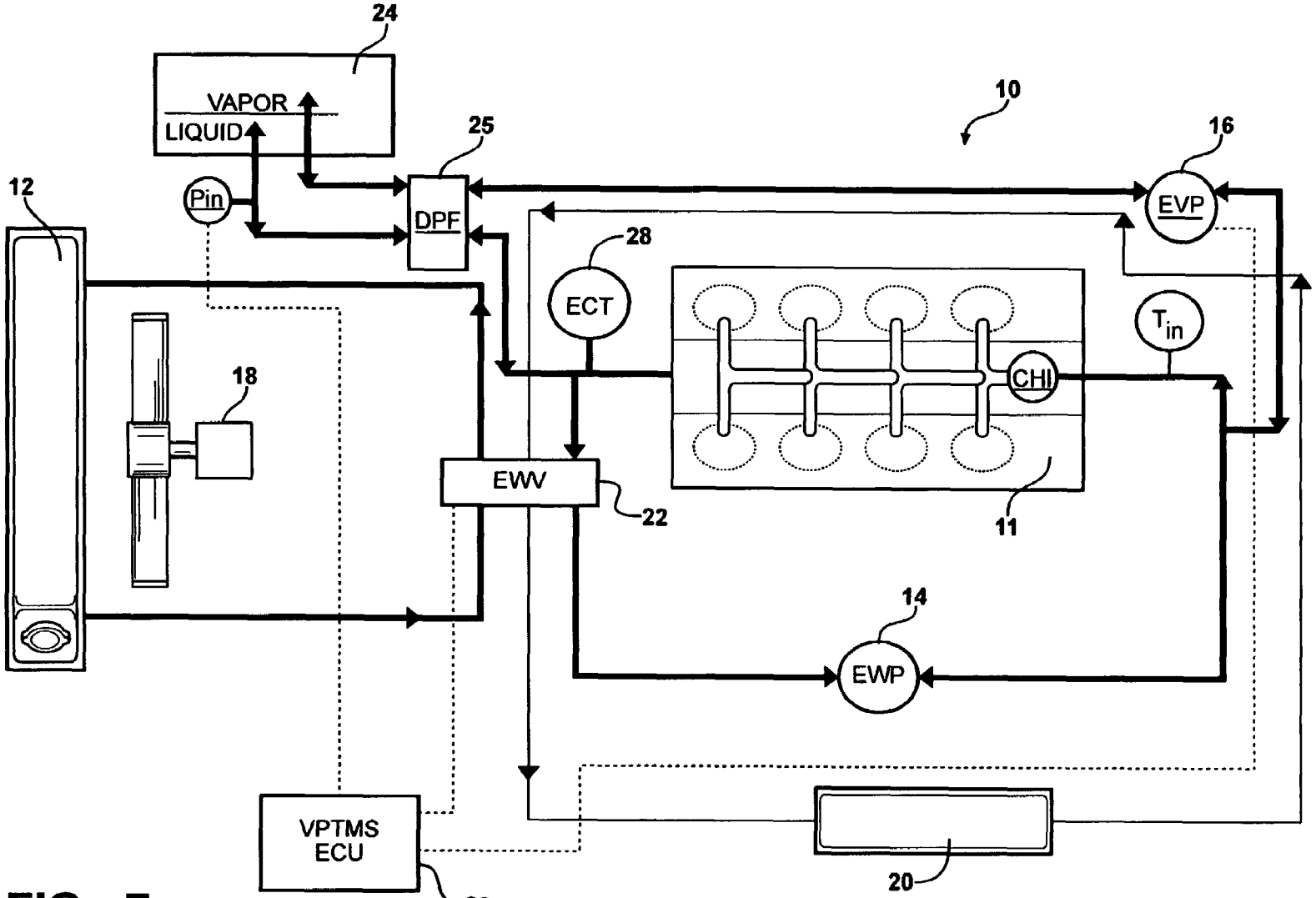
FIG. 7 is a schematic illustration of the thermal energy storage and management system when the system is in a cooling and initial operating mode.

FIG. 7 illustrates the thermal energy storage and management system 10 for the internal combustion engine 11 shown in FIG. 1 with the system 10 in a cooling and initial operating mode. In the cooling and initial operating mode, the engine 11 is off and the electric water pump 14 and the electric vapor pump 16 are not operating. The differential pressure valve 25 is closed to militate against the flow of fluid therethrough. The three position electric solenoid actuated valve 22 is universally closed to militate against the flow of fluid between the engine 11, the radiator 12, and the heater core 20. The electric fan 18 is operating to transfer thermal energy from fluid in the radiator 12 facilitated by an appropriate signal from the control unit 26. The cooling and initial operating mode is utilized to transfer thermal energy from fluid located in the radiator 12 as needed.

Figure 8:
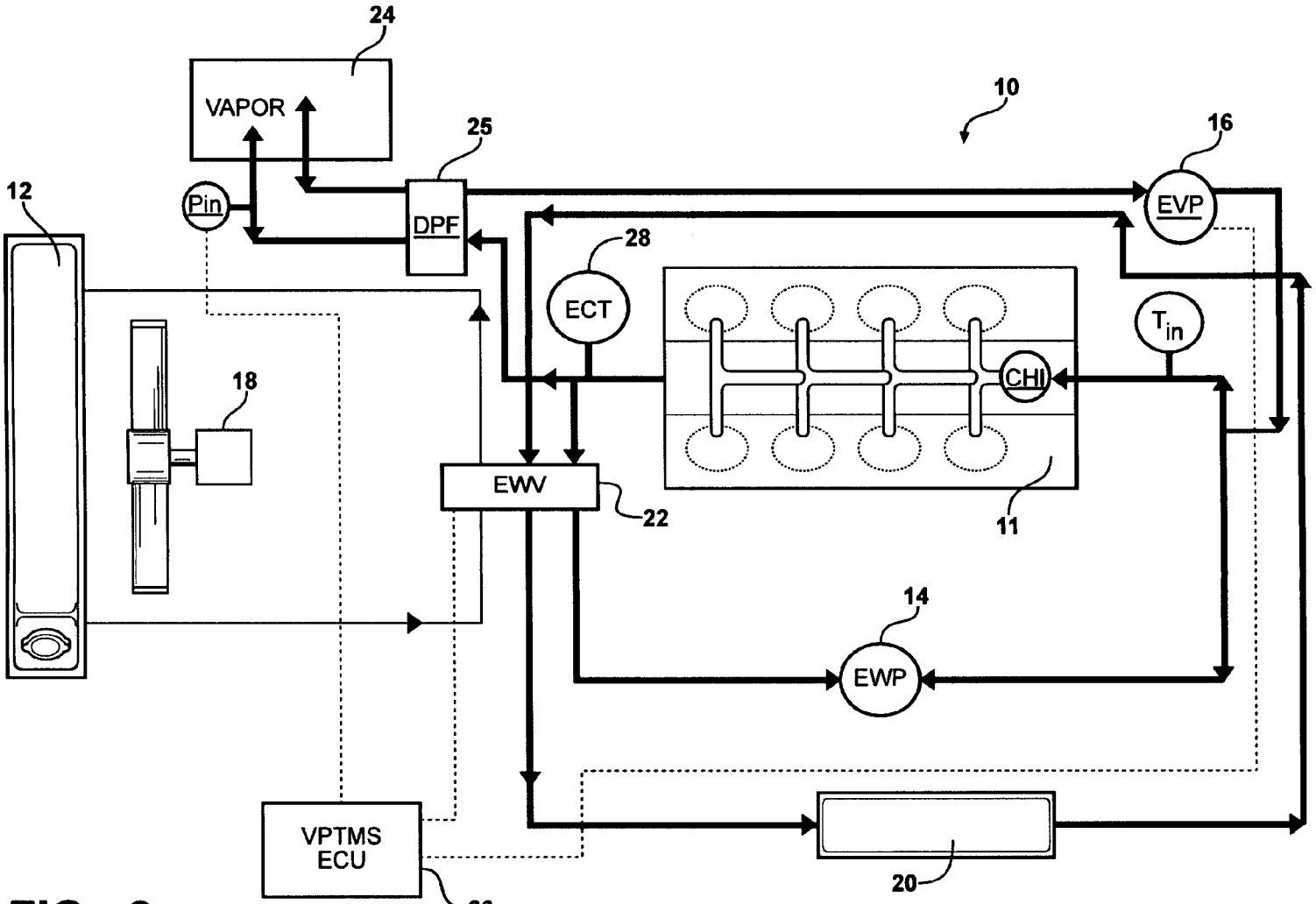
FIG. 8 is a schematic illustration of the thermal energy storage and management system when the system is in a heating and thermal heated fluid storage operating mode.

FIG. 8 illustrates the thermal energy storage and management system 10 for the internal combustion engine 11 shown in FIG. 1 with the system 10 in a heating and thermal energy storage operating mode. In the heating and thermal energy storage operating mode, the engine 11 is off and the electric water pump 14 is not operating. The differential pressure valve 25 is in an open position to allow fluid to travel therethrough. The three position electric solenoid actuated valve 22 is in universally closed position to militate against the flow of fluid therethrough. Heated fluid is pumped from the engine 11 by the electric vapor pump 16 through the differential pressure valve 25. The heated fluid flows through and transfers thermal energy to the thermal energy storage reservoir 24 and flows back through the differential pressure valve 25 to the engine 11 where it can be reheated by thermal energy of the engine 11 and redistributed to the thermal energy storage reservoir 24 facilitated by an appropriate signal from the electric control unit 26. The heating and thermal energy storage operating mode is utilized to transfer thermal energy to fluid located in the engine 11 and thereafter transfer thermal energy from the fluid to the thermal energy storage reservoir 24 as needed.

Figure 9:
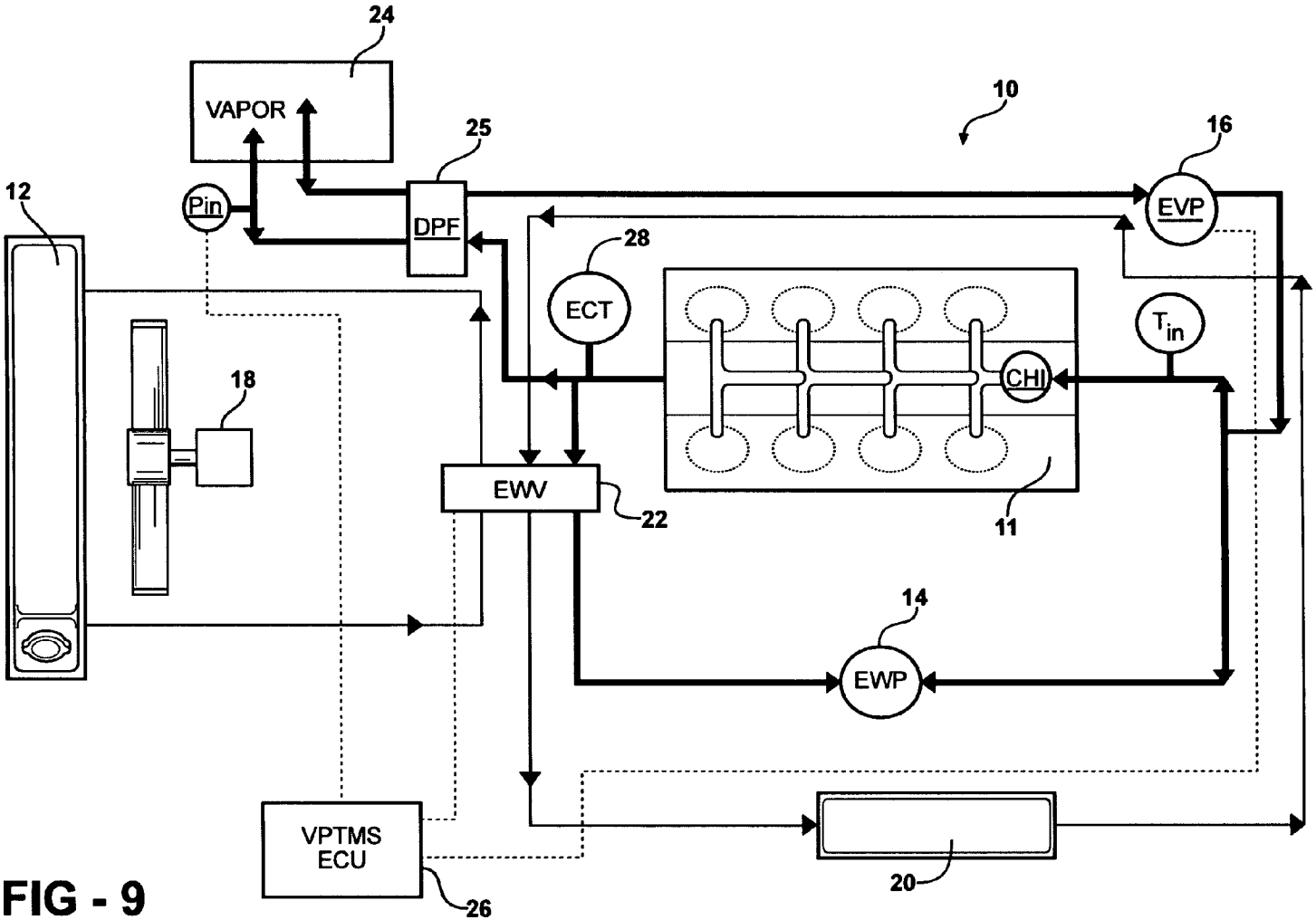
FIG. 9 is a schematic illustration of the thermal energy storage and management system when the system is in a self start operating mode.

FIG. 9 illustrates the thermal energy storage and management system 10 for the internal combustion engine 11 shown in FIG. 1 with the system 10 in a self start operating mode. In the self start operating mode, the engine 11 is on and the electric water pump 14 is not operating. The differential pressure valve 25 is in an open position to allow fluid to travel therethrough. The three position electric solenoid actuated valve 22 is in universally closed position to militate against the flow of fluid therethrough. Thermal energy is transferred to fluid located in the engine 11. The heated fluid is then pumped from the engine 11 by the electric vapor pump 16 through the differential pressure valve 25. The heated fluid flows through and transfers thermal energy to the thermal energy storage reservoir 24 and flows back through the differential pressure valve 25 to the engine 11 where it can be reheated by thermal energy of the engine 11 and redistributed to the thermal energy storage reservoir 24. The self start operating mode is utilized to prevent freezing of fluid located in the thermal energy storage reservoir 24 and facilitated by an appropriate signal from the electric control unit 26.

Figure 10:
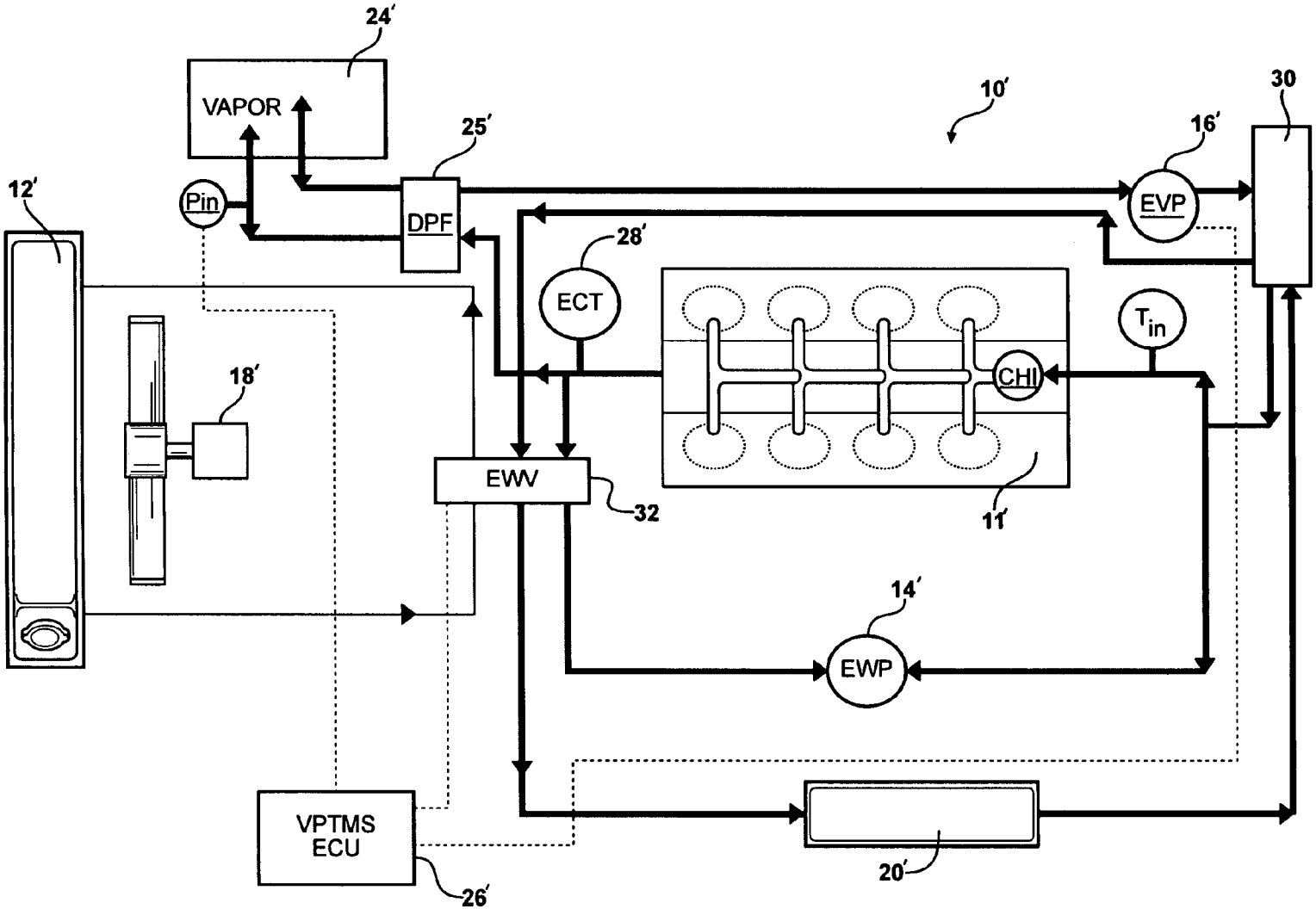
FIG. 10 is a schematic illustration of a thermal energy storage and management system for an internal combustion engine in accordance with another embodiment, of the invention, wherein the system is in a heating operating mode.

FIG. 10 is a schematic illustration of a thermal energy storage and management system 10' for the internal combustion engine 11' in accordance with another embodiment when the system 10' is in a heating operating mode. Similar structure to that described above for FIGS. 1-9 and repeated herein with respect to FIG. 10 includes the same reference numeral and a prime (') symbol. In this embodiment, the thermal energy storage and management system 10' includes a two position engine bypass valve 30. The two position engine bypass valve 30 is in fluid communication with the thermal energy storage reservoir 24' and the heater core 20'. The two position engine bypass valve 30 allows for a flow of fluid to by-pass the engine 11' and flow directly between the thermal energy storage reservoir 24' and the heater core 20'. The system 10' also includes a four position electric solenoid actuated valve 32 to replace the three position electric solenoid actuated valve shown in FIGS. 1-9. The system includes an on/off switch (not shown) in the passenger compartment (not shown) of the vehicle (not shown).

In this heating operating mode, the engine 11' is off and the electric water pump 14' is not operating. The differential pressure valve 25' is in an open position to allow fluid to travel therethrough. The four position electric solenoid actuated valve 32 is in an open position to allow fluid to recirculate through the heater core 20' and in a closed position to militate against the flow of fluid to and from the radiator 12' and the engine 11'. Heated fluid is pumped from the thermal energy storage reservoir 24' by the electric vapor pump 16' through the differential pressure valve 25', the two position engine bypass valve 30, and the four position electric solenoid actuated valve 32. The heated fluid flows through and transfers thermal energy to the heater core 20' and subsequently to the passenger cabin as actuated by a signal from the on/off switch operated by a passenger (not shown). The fluid can then flow back through the two position engine bypass valve 30 to the thermal energy storage reservoir 24' facilitated by an appropriate signal from the electric control unit 26'. This alternate heating mode can be selectively turned on and off by a passenger and is utilized to supply thermal energy stored in the thermal energy storage reservoir 24' directly to the heater core 20' while by-passing the engine 11' while the engine 11' is off.

Figure 11:
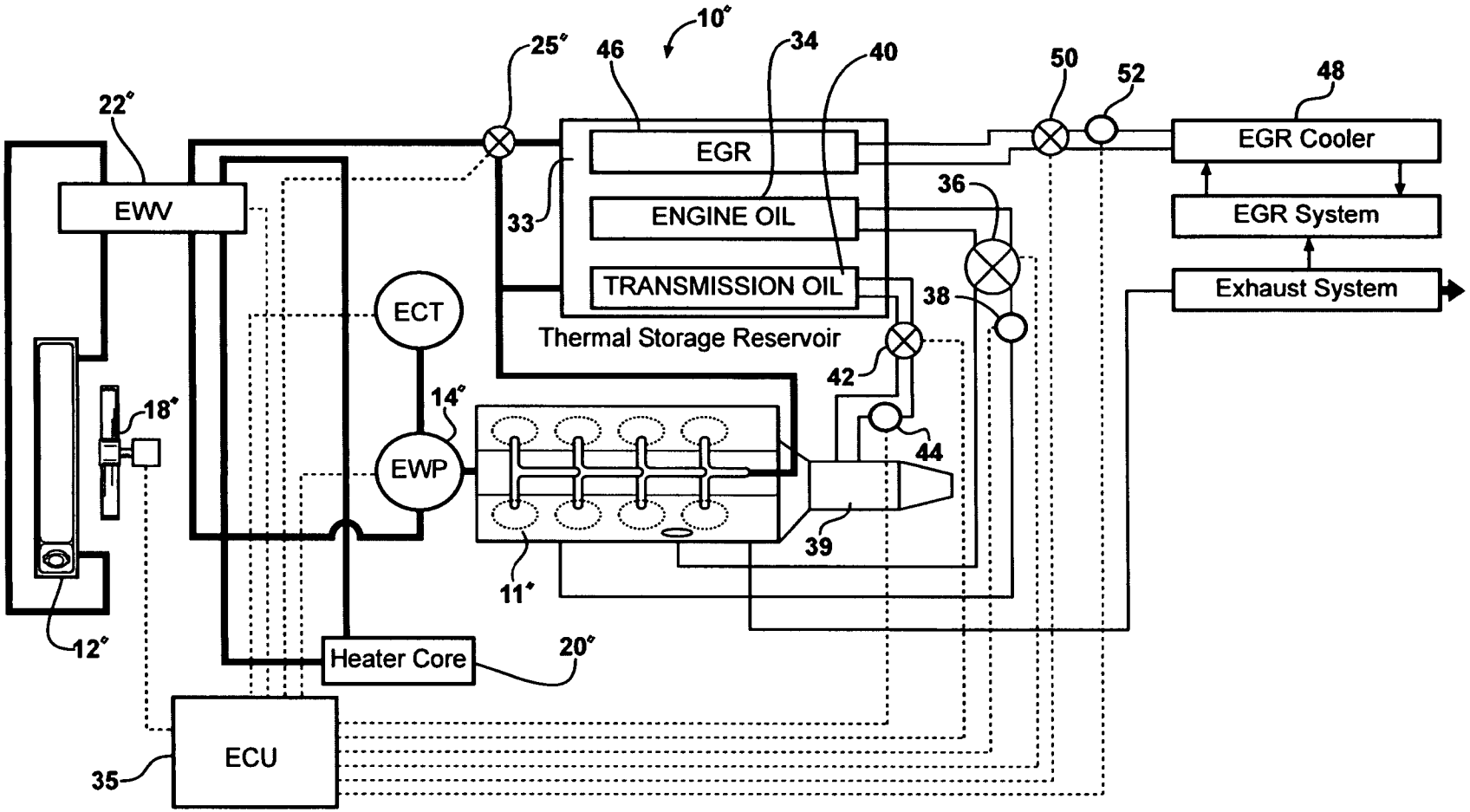
FIG. 11 is a schematic illustration of a thermal energy storage and management system for an internal combustion engine in accordance with another embodiment of the invention.

FIG. 11 schematically illustrates a system 10" incorporating the novel features of another embodiment of the invention. The system 10" includes an internal combustion engine 11", which is provided with a cooling system. Similar structure to that described above for FIGS. 1-9 repeated herein with respect to FIG. 11 includes the same reference numeral and a double prime (") symbol. The system includes a cooling radiator 12", an electric water pump 14", an electric fan 18", a heater core 20", a three position electric solenoid actuated valve 22", a differential pressure valve 25", a thermal energy storage reservoir 33, and an electric control unit 35.

Fluid communication is established between the radiator 12", the heater core 20", and the thermal energy storage reservoir 33 via the three position electric solenoid actuated valve 22". The three position electric solenoid actuated valve 22" can permit or militate against the flow of fluid between each of the radiator 12", the heater core 20", and the thermal energy storage reservoir 33 universally, wherein flow is permitted or militated against between all of the radiator 12", the heater core 20", and the thermal energy storage reservoir 33. The three position electric solenoid actuated valve 22" can also selectively permit or militate against the flow of fluid between the radiator 12", the heater core 20", and the thermal energy storage reservoir 33 separately. Fluid communication is further established between the three position electric solenoid actuated valve 22" and the thermal storage reservoir 33 via the differential pressure valve 25", which is actuated by an appropriate signal from the electric control unit 35. It will be appreciated that the various components of the system are coupled together, as illustrated, by appropriate fluid conveying conduits such as tubing and piping, for example.

The thermal energy storage reservoir 33 may be of a number of different types so long as it is capable of receiving a fluid used to convey the thermal energy developed during the normal operation of the engine 11". Optionally, the thermal energy storage reservoir 33 may be a type that includes the ability to change the phase of the fluid, such as from a liquid state to a gaseous state, for example. One example is a jar or bottle having a vacuum between an inner and outer wall, and sited to contain engine radiator coolant fluid as a primary thermal energy transfer medium. As will be explained in more detail hereinafter, the reservoir 24 can also enclose one or more sub-system reservoirs, in the range of from one to two liter capacity, to contain engine oil, transmission oil, and exhaust gas recirculator coolants. Favorable results have been realized when the thermal energy storage reservoir 24 is formed of an inner vessel and an outer housing separated by a vacuum which has been found to maintain thermal energy for a period up to seventy-two hours and having a volume of between 8 and 10 liters, for example.

The thermal energy storage reservoir 33, in addition to housing the engine radiator coolant as the primary thermal energy transfer medium, houses subsystem reservoirs for the engine lubricating oil; the transmission oil; and the exhaust gas recirculation fluid coolants.

An engine oil reservoir 34 is disposed within the main thermal energy storage reservoir 33. Fluid communication is established between the engine 11" and the engine oil reservoir 34 through suitable piping which typically includes a by-pass valve 36. A temperature sensor 38 monitors the temperature of the engine oil and is suitably coupled, typically electrically, with the electric control unit 35.

A transmission oil reservoir 40 is disposed within the main thermal energy storage reservoir 33. Fluid communication is established between the transmission 39 of the engine 11 and the transmission oil reservoir 40 through suitable piping which typically includes a by-pass valve 42. A temperature sensor 44 monitors the temperature of the transmission oil and is suitably coupled, typically electrically, with the electric control unit 35.

An exhaust gas recirculation reservoir 46 is disposed within the main thermal energy storage reservoir 33. Fluid communication is established between the exhaust gas cooler 48 of the exhaust gas recirculation system and the exhaust gas recirculation reservoir 46 through suitable piping which typically includes a by-pass valve 50. A temperature sensor 52 monitors the temperature of the exhaust gas recirculation coolant in the reservoir 46 and is coupled, typically electrically, with the electric control unit 35.

During a system operations mode, the three position electric solenoid operated valve 22", the engine oil by-pass valve 36, the transmission oil by-pass valve 42, and the exhaust gas by-pass valve 50 are actuated by appropriate signals from the control unit 35 based on temperature readings supplied to the control unit 35 from the temperature sensors 38, 44, 52. The motive forces produced by the electric water pump 14" selectively cause the fluid to be conveyed through the passageways to transfer thermal energy to the engine 11", the radiator 12", the heater core 20", the thermal energy storage reservoir 33, the engine oil reservoir 34, the transmission 39, the transmission oil reservoir 40, the exhaust gas reservoir 46, and the exhaust gas cooler 48 based on appropriate electrical signals from the control unit 35. Specifically, the electric water pump 14" causes the fluid to flow through the three position electric solenoid operated valve 22" to the engine 11", the radiator 12", the heater core 20", the thermal energy storage reservoir 33, the engine oil reservoir 34, the transmission 39, the transmission oil reservoir 40, the exhaust gas reservoir 46, and the exhaust gas cooler 48.

The thermal energy of the system may be controlled by the three position electric solenoid operated valve 22", the differential pressure valve 25", the engine oil by-pass valve 36, the transmission oil by-pass valve 42, and the exhaust gas by-pass valve 50, which control the rate of flow of fluid therethrough and hence through the heat exchange elements of the radiator 12", the heater core 20", and the thermal energy storage reservoir 33. Specifically, the three position electric solenoid operated valve 22" permits or militates against the flow of fluid to the engine 11", the radiator 12", and the heater core 20" based on an appropriate signal from the control unit 35. The differential pressure valve 25" permits or militates against the flow of fluid from the three position electric solenoid operated valve 22" to the thermal energy storage reservoir 33. The engine oil by-pass valve 36 permits or militates against the flow of fluid from the engine 11" to the engine oil reservoir 34. The transmission oil by-pass valve 42 permits or militates against the flow of fluid from the transmission 39 to the transmission oil reservoir 40. The exhaust gas by-pass valve 50 permits or militates against the flow of fluid from the exhaust gas cooler 48 to the exhaust gas reservoir 46.

The thermal energy storage reservoir 33 is utilized to store thermal energy from the engine 11" as the fluid is caused to flow through the system by the motive force produced by the electric water pump 14. The thermal energy storage reservoir 33 acts as an inherent thermal energy balance device, to either add heat energy to or remove heat energy from the thermal energy storage and management system 10". It will be understood that the thermal energy storage reservoir 33 is effective to efficiently retain heat energy and allow the energy transfer fluid retained therein to absorb heat energy from or release heat energy to the engine oil reservoir 34, the transmission oil reservoir 40, and the exhaust gas recirculation reservoir 46. Due to the insulating properties of the thermal energy storage reservoir 33, the thermal energy transfer fluid flowing therethrough minimizes energy loss so that when the system 10" is shut down, the thermal energy transfer fluid within the thermal energy storage reservoir 33 will maintain the thermal energy for subsequent use. If the phase changing function is utilized by the thermal storage reservoir 33, fluid that enters in a liquid state can be heated and changed into a vapor or gaseous state. Energy needed to implement the phase change can be supplied by any traditional means such as a battery powered thermal electric device, for example.

The advantages achieved by the illustrated and described thermal energy and management system 10" includes start-up efficiencies of the associated engine. Immediately upon start-up the system 10" utilizes the stored thermal energy to heat components of the engine 11". Therefore, the wear on the engine 11" during start-up is substantially reduced resulting in increased engine durability. If desired, the passenger cabin can also be supplied with heat immediately upon start-up.

Fuel efficiency is maximized and exhaust gas pollutants are minimized due to the engine more rapidly reaching a maximum operating temperature. Suitable signals from the electrical control unit 35 will control the flow of heat energy to or from the thermal energy storage reservoir 33.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A thermal energy recovery and management system comprising: a thermally insulated primary reservoir for storing thermal energy;

at least one sub-reservoir which is fully enclosed within said primary reservoir, in thermal energy exchange relationship with the primary reservoir and in fluid communication with at least one of an engine, a transmission, and an exhaust gas recirculator;

a first fluid circuit providing communication between the primary reservoir and the engine;

a second fluid circuit providing communication between the at least one sub-reservoir and at least one of the engine, the transmission, and the exhaust gas recirculator;

a control unit for selectively controlling fluid communication in the first fluid circuit between the primary reservoir and the engine, and in the second fluid circuit between the at least one sub-reservoir and the at least one of the engine, the transmission, and the exhaust gas recirculator to maintain a balance of thermal energy in the reservoirs, the internal combustion engine, and the at least one of the engine, the transmission, and the exhaust gas recirculator;

a means for providing a motive force for causing a thermal energy conveying fluid to flow between the primary reservoir and the engine; and a means for providing a motive force for causing a thermal energy conveying fluid to flow between the at least one sub-reservoir and at least one of the engine, the transmission, and the exhaust gas recirculator.

2. A thermal energy recovery and management system as defined in claim 1, wherein the first fluid circuit includes a fluid passageway selectively interconnecting the primary reservoir to a radiator, a heater core, and the engine and the second fluid circuit includes a fluid passageway selectively interconnecting the at least one sub-reservoir to at least one of the engine, the transmission, and the exhaust gas recirculator.

3. A thermal energy recovery and management system as defined in claim 1, further comprising a second sub-reservoir in thermal energy exchange relationship with the primary reservoir and in fluid communication with another of the engine, the transmission, and the exhaust gas recirculator.

4. A thermal energy recovery and management system as defined in claim 3, further comprising a third sub-reservoir in thermal energy exchange relationship with the primary reservoir and in fluid communication with another of the engine, the transmission, and the exhaust gas recirculator.

5. A thermal energy recovery and management system as defined in claim 1, further comprising a means for providing a motive force for causing a thermal energy conveying fluid to flow between the engine and at least one of the first sub-reservoir, the second sub-reservoir, and the third sub-reservoir.

6. A thermal energy recovery and management system as defined in claim 1, further comprising a means for providing a motive force for causing a thermal energy conveying fluid to flow between the transmission and at least one of the first sub-reservoir, the second sub-reservoir, and the third sub-reservoir.

7. A thermal energy recovery and management system as defined in claim 1, further comprising a means for providing a motive force for causing a thermal energy conveying fluid to flow between the exhaust gas recirculator and at least one of the first sub-reservoir, the second sub-reservoir, and the third sub-reservoir.

8. A thermal energy recovery and management system for an engine including at least, an exhaust gas recirculation and a transmission, the system comprising: a thermally insulated primary reservoir for storing thermal energy;

a first sub-reservoir which is fully enclosed within said primary reservoir, in thermal energy exchange relationship with the primary reservoir and in fluid communication with the engine;

a second sub-reservoir which is fully enclosed within said primary reservoir, in thermal energy exchange relationship with the primary reservoir and in fluid communication with the transmission;

a third sub-reservoir which is fully enclosed within said primary reservoir, in thermal energy exchange relationship with the primary reservoir and in fluid communication with the exhaust gas recirculator;

a first fluid circuit providing communication between the primary reservoir and at least one of a radiator and a heater core;

a second fluid circuit providing communication between the first sub-reservoir and the engine;

a third fluid circuit providing communication between the second sub-reservoir and the transmission;

a fourth fluid circuit providing communication between the third sub-reservoir and the exhaust gas reciculator;

a control unit for selectively controlling fluid communication in the first fluid circuit between the primary reservoir and at least one of the radiator and the heater core, in the second fluid circuit between the first sub-reservoir and the engine, in the third fluid circuit between the second sub-reservoir and the transmission, and in the fourth fluid circuit between the third sub-reservoir and the exhaust gas recirculator to maintain a balance of thermal energy in the reservoirs, the engine , transmission, and the exhaust gas recirculator;

a means for providing a motive force for causing a thermal energy conveying fluid to flow between the primary reservoir and at least one of the radiator and the heater core;

and at least one means for providing a motive force for causing a thermal energy conveying fluid to flow between at least one of the first sub-reservoir and the engine, the second sub-reservoir and the transmission, and the third sub-reservoir and the exhaust gas recirculator.

9. A thermal energy recovery and management system as defined in claim 8, wherein each of the first sub-reservoir, the second sub-reservoir, and the third sub-reservoir define a fluid impervious zone within the primary reservoir.

10. A thermal energy recovery and management system for an internal combustion engine as defined in claim 8, wherein the first fluid circuit includes a fluid passageway selectively interconnecting the primary reservoir to at least one of the radiator and the heater core, the second fluid circuit includes a fluid passageway selectively interconnecting the first sub-reservoir to the engine, the third fluid circuit includes a fluid passageway selectively interconnecting the second sub-reservoir to the transmission, and the fourth fluid circuit includes a fluid passageway selectively interconnecting the third sub-reservoir to the exhaust gas recirculator.

* * * * *